United States Patent [19]

Bains

[11] 3,944,207

[45] Mar. 16, 1976

[54] LIMITLESS SORTER

[75] Inventor: Sudarshan S. Bains, Rochester, N.Y.

[73] Assignee: Xerox Corporation, Stamford, Conn.

[22] Filed: Dec. 27, 1973

[21] Appl. No.: 429,003

[52] U.S. Cl. ..... 270/58; 271/173; 214/6 M

[51] Int. Cl.[2] ..... B65H 39/02

[58] Field of Search ..... 355/3, 14; 270/37, 53, 270/58–59; 271/64, 173, 210; 227/85, 100; 209/74 R, 71–74; 317/2 A

[56] References Cited

UNITED STATES PATENTS

| | | | |
|---|---|---|---|
| 2,634,971 | 4/1953 | Schweizer | 270/55 |
| 3,561,356 | 2/1971 | Rarey | 317/2 A |
| 3,708,160 | 1/1973 | Kantarian | 270/53 |

*Primary Examiner*—Edgar S. Burr
*Assistant Examiner*—A. Heinz

[57] ABSTRACT

An improved collating apparatus for a high speed duplicator machine, including a set of collating bins for collating the copy sheets being produced by the machine, a set of collecting bins, means for releasing the collated sheets into the collecting bins. The bottom members of the collating bins are operable to open for releasing the collated sheets into the collecting bins whereby the collating bins are conditioned to be ready for a succeeding cycle of operation without interruption, if required. The apparatus may be also provided with vibrating means to jog the collated sheets to align the edges thereof for subsequent removal. The improved apparatus provides an increased throughput capacity to the machine, simplifies the mechanism and control circuitry involved and makes optimal utilization of the space provided for the machine.

6 Claims, 10 Drawing Figures

LIMITLESS SORTER

This invention relates generally to a collating apparatus for copying systems and, in particular, to a system for producing unlimited number of collated copy sets from a set of documents arranged in a predetermined order.

High speed copier/duplicators has created a need for improved collating apparatus for handling the outputs of the machine produced at a relatively high speed. An inventive and novel apparatus meeting such a demand is disclosed in U.S. Pat. No. 3,830,590, assigned to the present assignee.

According to the approach disclosed therein, a collating apparatus is shown to include two sets of 25 collating bins. The apparatus includes means including a control logic circuitry for operating the two set of bins in a limitless sort mode wherein, if the number of copies to be made exceeds the capacity of one set of bins, the machine is arranged to fill the one set so that while the other set is being filled, the operator can empty the one set of bins that have been filled to get them ready for further collating operation.

While the apparatus disclosed in the pending application provides significant improvements in that it enables the machine to collate without limit, it has certain areas which can stand a further improvement.

SUMMARY OF THE INVENTION

It is an object of the present invention to provide an improved collating apparatus.

It is another object of the invention to provide an improved limitless collator for use with copiers or duplicators.

It is a further object of this invention to combine an office copier, a document handling device and a collator to produce unlimited sets of collated copies of original documents.

It is a further object of this invention to maximize the utilization of the space provided for the equipment required for producing large number of collated documents.

It is a further object of this invention to increase throughput capacity of copiers or duplicators.

It is a further object of this invention to minimize the complexity of collating apparatus.

It is another object of this invention to automate the collating and edge aligning operations in handling copy sheets.

According to the present invention, the aforementioned and other objects of the present invention are achieved by a collating apparatus having a set of collating bins for collating the copy sheets produced by the machine, a set of collecting bins and, suitable mechanisms and control circuitry for releasing the collated sheets into the collecting bins.

It is a feature of the present invention to provide means for automatically releasing the collated sheets and then preparing the collating bins and apparatus for a succeeding cycle of operation.

It is another feature of the present invention to provide means for jogging collated sets of copy sheets simultaneously to align their edges.

The foregoing and other objects and features will become clearer from the following detailed description of an illustrative embodiment of the present invention in conjunction with the accompanying drawings, in which.

DETAILED DESCRIPTION

Figure 1:
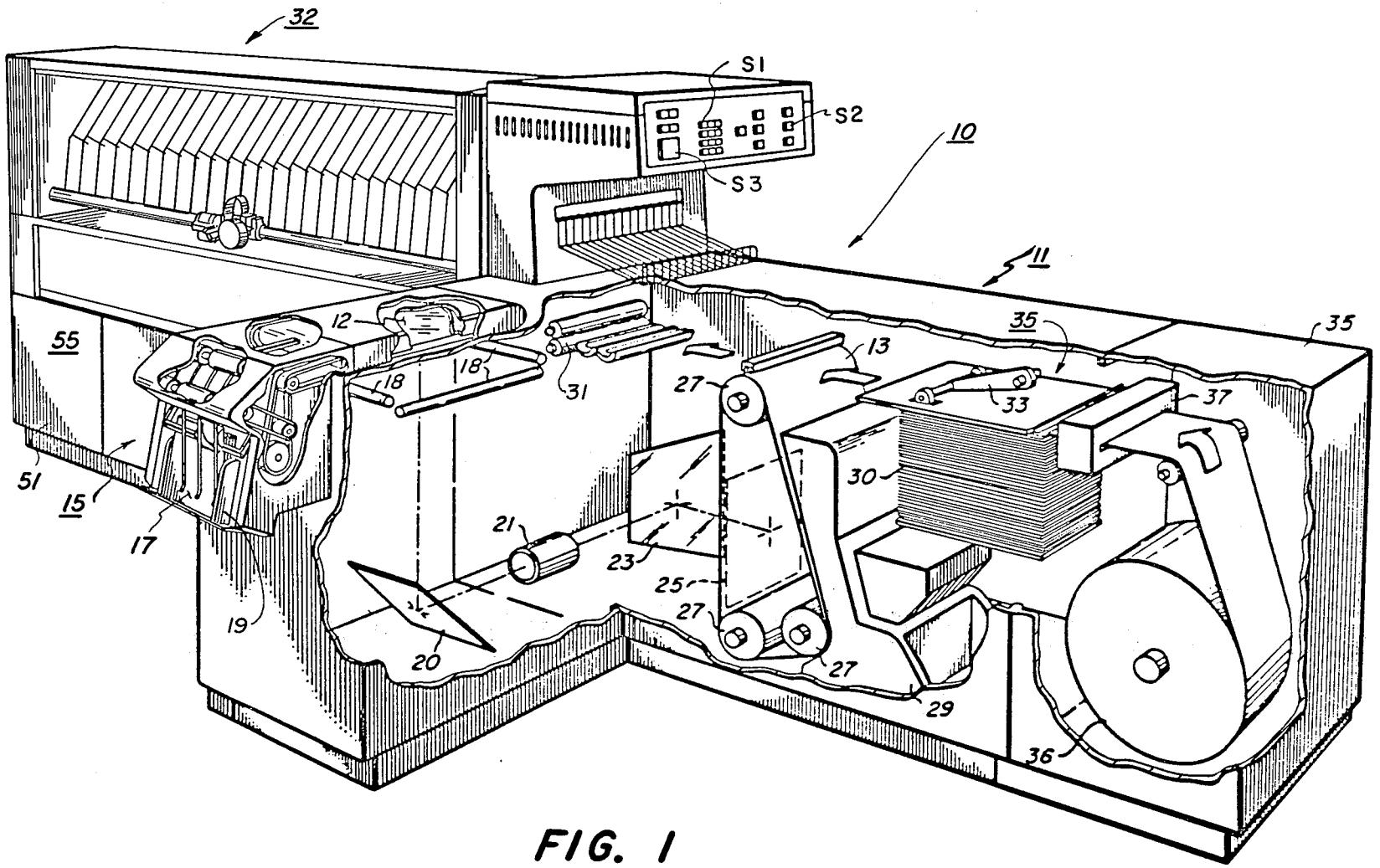
FIG. 1 is a perspective view of a copying machine incorporating a limitless collating apparatus according to the present invention.

For a general understanding of reproduction apparatus in which the present collating apparatus may be incorporated, reference is made to FIG. 1 wherein various components of a typical electrostatic printer system are illustrated. The printer system may be of the xerographic type and is generally designated with the reference numeral 11. As in all xerographic systems, a light image of an original to be reproduced is projected onto the sensitized surface of a xerographic plate to form an electrostatic latent image. Thereafter, the latent image is developed with toner material to form a xerographic powder image corresponding to the latent image on the plate surface. The powder image is then electrostatically transferred to a record material such as a sheet or web of paper or the like to which it may be fused by a fusing device whereby the powder image is caused permanently to adhere to the surface of the record material.

The xerographic processor indicated by the reference numeral 11 is arranged as a selfcontained unit having all of its processing stations located in a unitary enclosure or cabinet. The printer system includes an exposure station at which a document to be reproduced is positioned on a glass platen 22 for projection onto a photoconductive surface in the form of a xerographic belt 13. The document is transported by a recirculating document feed apparatus 15 from the bottom of a stack 17 on a supply tray 19 to the platen for exposure and then returned to the top of the supply tray on completion of the exposure until the entire stack has been copied at which time the cycle may be repeated as described in U.S. Pat. No. 3,556,512 entitled "Document Feed Apparatus" and commonly assigned with the present invention.

Imaging light rays from the document which is flash illuminated by lamps 18 are projected by a first mirror 20 and a projection lens 21 and another mirror 23 onto the xerographic belt 13 at the focal plane for the lens 21 at a position indicated by the dotted line 25.

As an interface structure and for unobstructed optical projections, the side of the cabinet is formed with an enlarged rectangular opening to permit the projection of image light rays from the lens 21 to the mirror 23. Similarly, the cabinet supporting the document plane is formed with a corresponding rectangular opening that mates with the opening in the printer cabinet when the two cabinets are operatively joined together for copying purposes. Suitable light tight gaskets may be utilized adjacent the exterior of each opening in the cabinets in order to minimize the leakage of unwanted extraneous light.

The xerographic belt 13 is mounted for movement around three parallel arranged rollers 27 suitably mounted in the frame processor 11. The belt may be continuously driven by a suitable motor (not shown) and at an appropriate speed. The exposure of the belt to the imaging light rays from the document discharges the photoconductive layer in the area struck by light whereby there remains on the belt an electrostatic latent image corresponding to the light image projected from the document. As the belt continues its movement, the electrostatic latent image passes a developing station at which there is positioned a developer apparatus 29 for developing the electrostatic latent image. After development, the powdered image is moved to an image transfer station whereat record material or sheet of paper just previously separated from a stack of sheets 30 is held against the surface of the belt to receive the developed powder image therefrom. The sheet is moved in synchronism with the movement of the belt during transfer of the developed image. After transfer, the sheet of paper is conveyed to a fusing station where a fuser device 31 is positioned to receive the sheet of paper for fusing the powder thereon. After fusing of the powder image, the sheet is conveyed through an opening in the cabinet to a limitless collating apparatus 32 as will be described hereinafter. The sheets are separated from the stack and fed from the top of the stack by means of a separator roll device 33 in timed sequence with the movement of the developed latent images on the belt 13.

Further details of the processing devices and stations in the printer system are not necessary to understand the principles of the present invention. However, for a detailed description of these processing stations and components along with the other structures of the machine printer, one may refer to U.S. Pat. Nos. 3,661,452 and 3,597,071, respectively which are commonly assigned with the present invention.

It will be appreciated that the printer system may be operated in conjunction with a roll converter unit indicated by the reference numeral 35. The roll converter unit 35 is adapted to convert a relatively large roll of paper 36 into various sizes of sheets of paper by means of a cutter device 37 and a suitable control system (not shown) arranged to control cutting and feeding of the individual sheets into operative cooperation with the separator roller 33. It will be appreciated that operative cooperation is assured between the various units operating with the printer system by the physical association of the cabinets for the units and the matching openings which enable full cooperation of the imaging light rays and sheet transport path between the units. In this regard, locking clamps may be provided on all the units for preventing the inadvertent movement of such units during use and interlocks incorporating an alignment device may be utilized on each unit for ensuring proper alignment and to terminate or suspend operation in the event of misalignment of separation of the unit occurs. For facility and needs of operation, each of the units may be provided with caster wheels and locking brakes thereby aiding in the movement of the units into and out of cooperative engagement.

LIMITLESS COLLATING APPARATUS

Figure 2:
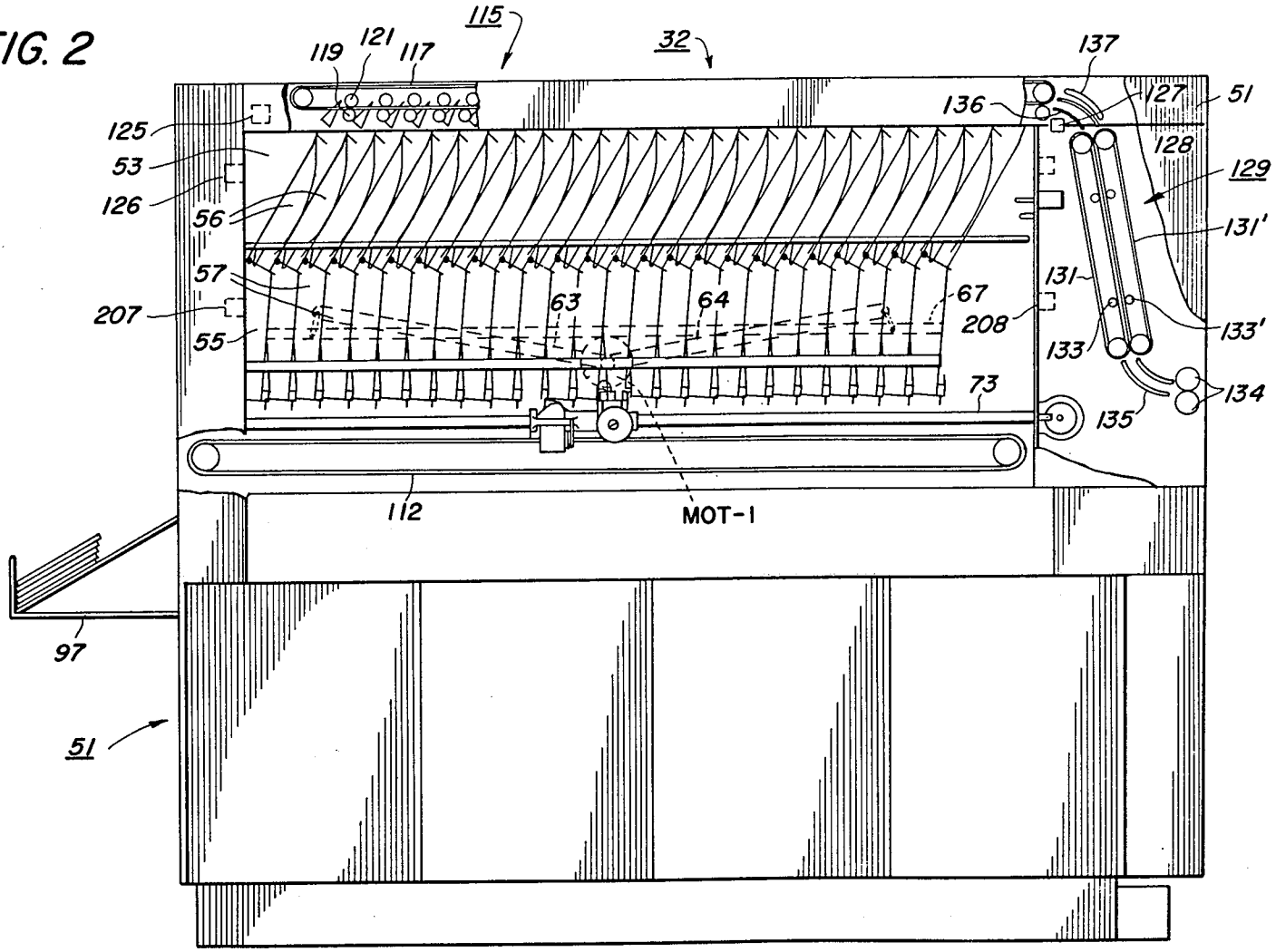
FIG. 2 is a schematic front view of the collating apparatus.
Figure 3:
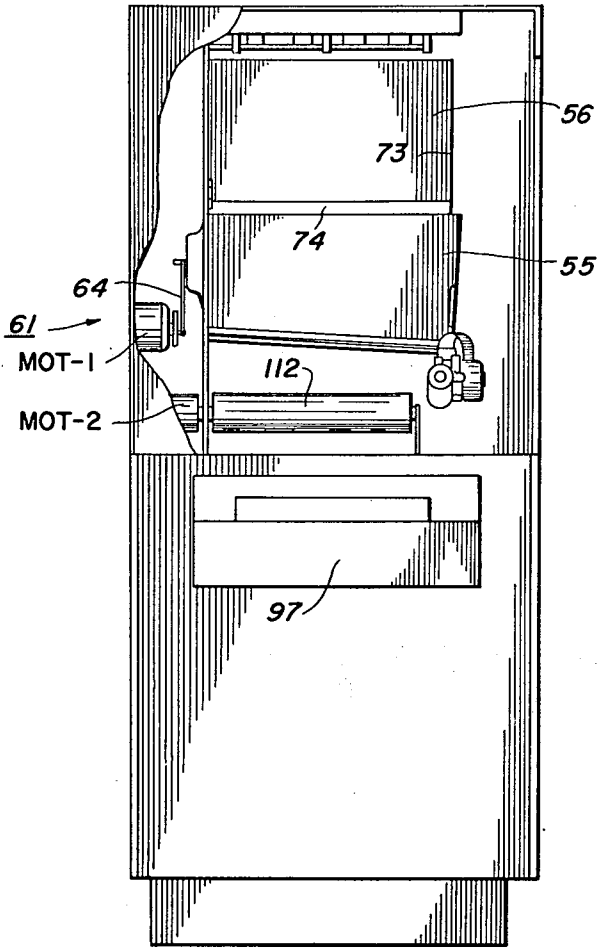
FIG. 3 is a schematic side view of the collating apparatus.
Figure 4:
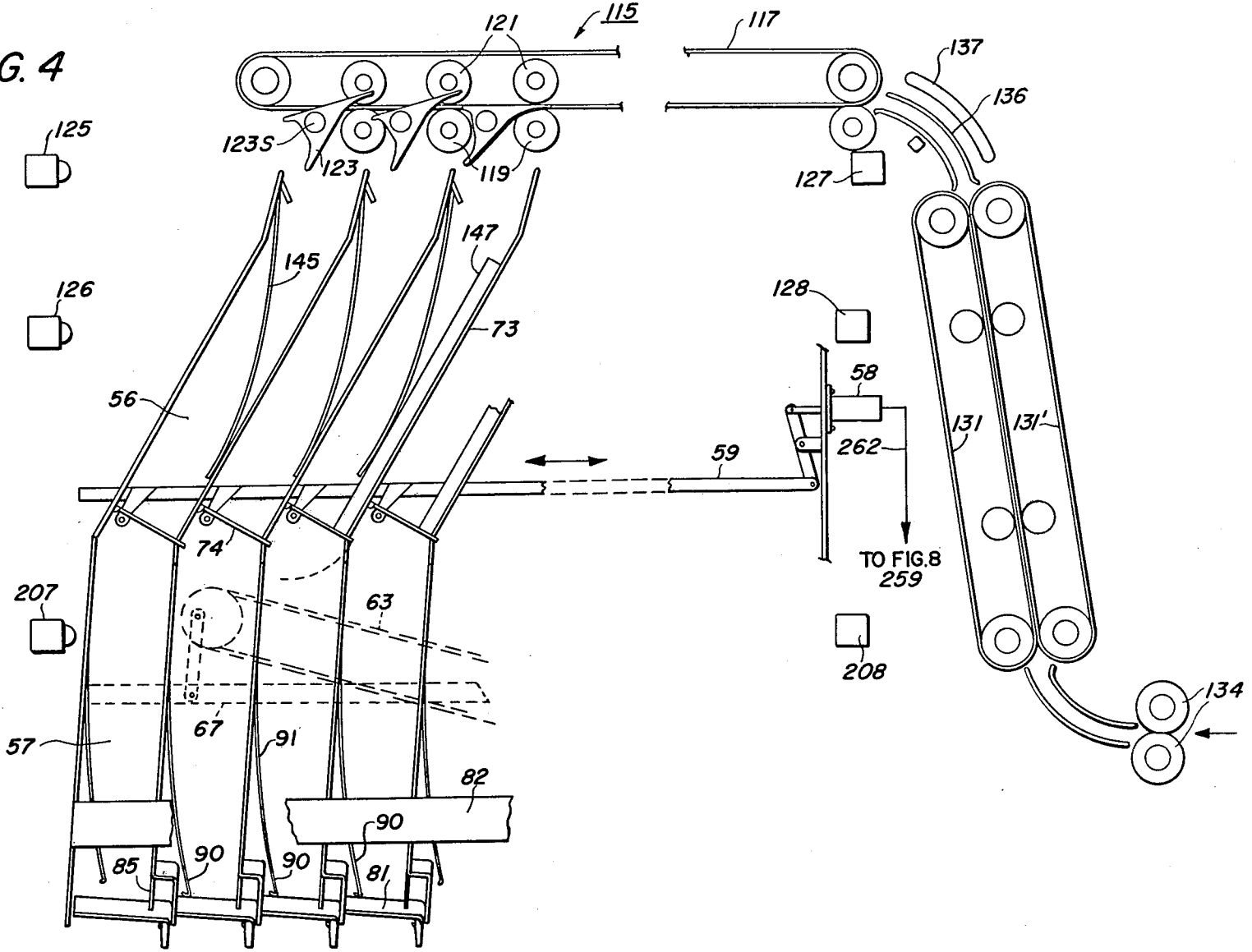
FIG. 4 is a segmented enlarged schematic view of a portion of the collating and collecting bins.

Referring now to FIGS. 2, 3 and 4, a limitless collating apparatus 32 according to the present invention comprises a base frame 51 which supports an upper and a lower bin assemblies 53 and 55, respectively. Upper assembly 53 includes a unitary framework which defines a series of bins or trays 56 which receive copy sheets in a downward direction. Lower assembly 55 has a unitary framework which defines a series of trays or bins 57 for receiving the collated copy sheets from the upper or collating bins 56.

Figure 6:
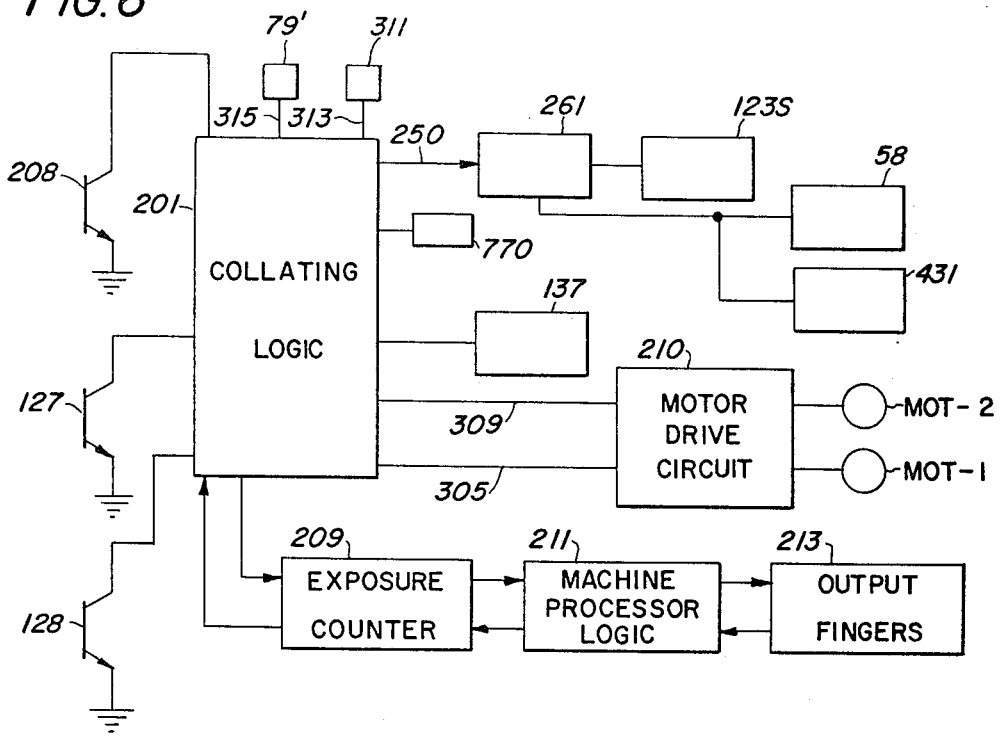
FIG. 6 is block diagram of the control circuitry for the collating apparatus.

The upper or collating assembly includes a transport 115 made up of horizontal belts 117 driven by a motor (not shown) and free wheeling rollers 119 positioned below the sheet path. Above the rollers 119 there are another set of rollers 121 which are positioned in belts 117 to ensure proper traction. Fingers or gate members 123 serve to deflect the copy sheet into the bins or trays when actuated by a solenoid control logic of a suitable design under the control of the machine control logic (FIG. 6). The control logic is of a suitable design such that initially all of the solenoids for the fingers 123, except for the left most finger, are de-energized to leave the gates open. The copy sheet reaching the collating module or the upper assembly of bins is therefore directed to the first bin at the left most location. As the sheet entering into the left most bin cuts off the light from a light source 125 momentarilly, this is sensed by a photodetecting means such as a phototransistor 127, in the form of a pulse signal. The pulse signal is then sent out to a machine control logic (FIG. 6). The logic in turn actuates the solenoid for the second bin from the left most to direct the next sheet to the next bin, and so on, until all of the 25 bins provided for the collating operation are filled or lesser of number of bins, as may be programmed for the copy run.

To transport the copy sheets into the upper or collating assembly, there is provided a vertical transport 129 disposed as shown off the horizontal transport 115 which is made up of a vertical belt 131 which moves against another belt 131'. The vertical belts are disposed at an incline, as shown as much as the frame 51 and other features of the machine would allow, so that the paper sheet path does not make abrupt right angle bends. There may be provided a pair of pinch wheels 134 which may be driven by a drive off the vertical transport to propel the sheet member being directed to the collating bins. The sheet member propelled forward in the horizontal plane is then deflected upwardly toward the vertical transport 129 by a deflector 135. The vertical transport 129 receives the sheets from the deflector 135 and the two belts 131 – 131' carry the sheets upwardly.

At the exit end, there is provided a deflecting guide means 136 of a suitable design which guides the sheet into the horizontal path of travel path defined by the horizontal transport means 115.

There is provided an anti-static bar 137 which is energizable during the operation of the collating operation for removing the static electricity usually built up on the copy sheets during its travel. It has been found that often the static electricity built up in the sheet causes trouble in the collating bins and may cause a paper jam. This occurs because the sheets being collated in the bins do not lose the static electricity for a while. As a result the new incoming sheets are prevented from falling all the way down to the bottom of the respective bins by the attracting force of the static electricity. Instead the successive sheets dropped into a bin tend to stick to the sheets already there before they reach the bottom and consequently the successive sheets 'crawl up' or stagger upwardly. Eventually this causes the upper ends of the sheets to reach the entrance from the horizontal transport to the bins in the vicinity of the finger 123. It has been found that, as a result, the bin capacity is materially reduced and in some cases the bin entrance is jammed by the statically charged copy sheets blocking them. The aforementioned difficulty is significantly reduced by removing the static electricity in the sheet by the anti-static bar 137. The anti-static bar 137 is actuable by the machine control logic (FIG. 6).

Now referring to FIG. 4, respective collating bins 56 include side walls or frame 73 and a releasable retaining bottom 74 for retaining the copy sheets deposited therein from the xerographic copier and dropped into the bins. The bottom 74 of the bins are releasably mounted so that in their normal position they are closed so that they retain the sheets coming into the bins while the collating operation takes place, but they can be opened to release the collated sheets when they are ready to be released. The released sheets are then dropped into the collecting bins 57.

Preferably, the entrance ways of the collating bins 56 are disposed as closed to the gate fingers 123 as possible. There is provided flexible retaining members 145 positioned to guide the sheets into the bottom of the bins. This arrangement reduces the curling or spreading of the top ends 147 of the sheets and thereby prevents or reduces the tendency of the curled upper ends from blocking the entry of sheets. This increases the net or effective capacity of the bins in receiving and holding the sheets.

For the opening and closing operation of the bottoms of the collating bins, any suitable actuable means may be used such as that schematically illustrated in FIG. 4. For example, it may comprise bottom members 74 hingedly coupled to a bottom end of the vertical members of the bins. A linkage arm 59 is provided to couple the bottom members to a suitable means such as a solenoid means 58 actuable upon completion of a collating operation by a signal provided by the collating logic 201 via a signal path 262.

The bottom assembly may be of a unitary frame as illustrated in FIG. 2 that has a set of bins 57 corresponding in number to those in the upper assembly. The bottom bins are disposed directly below the corresponding collating bins 56 and are aligned so that they receive the copy sheets when they are released from the collating bins.

In accordance with an aspect of the present invention, there may be provided a suitable vibrating means, such as that illustrated in FIGS. 2 and 3. The vibrating means 61 may include a motor MOT-1 mounted in the back of the lower assembly 55 to drive a pair of drive belts 63 and 64. The belts 63 and 64 are in turn used to drive a suitable reciprocating member 67 to vibrate the lower assembly 55.

In order to enable the bottom bins to align the edges of the collating means more effectively, the bottom bins are disposed at a slant toward the front and to the right a little and the bottom members 81 are also slanted to the right, as illustrated by FIGS. 3 and 4. In this manner, when the bins are vibrated by the running belts 63 and 64, the sheets jog and align as they incline slightly to the right and to the front. In this manner the front and bottom edges of the sheets are aligned. To prevent the sheets from spilling out toward the front, a suitable barrier 82 (FIG. 4) is placed on the front side of the bins 57.

Figure 5:
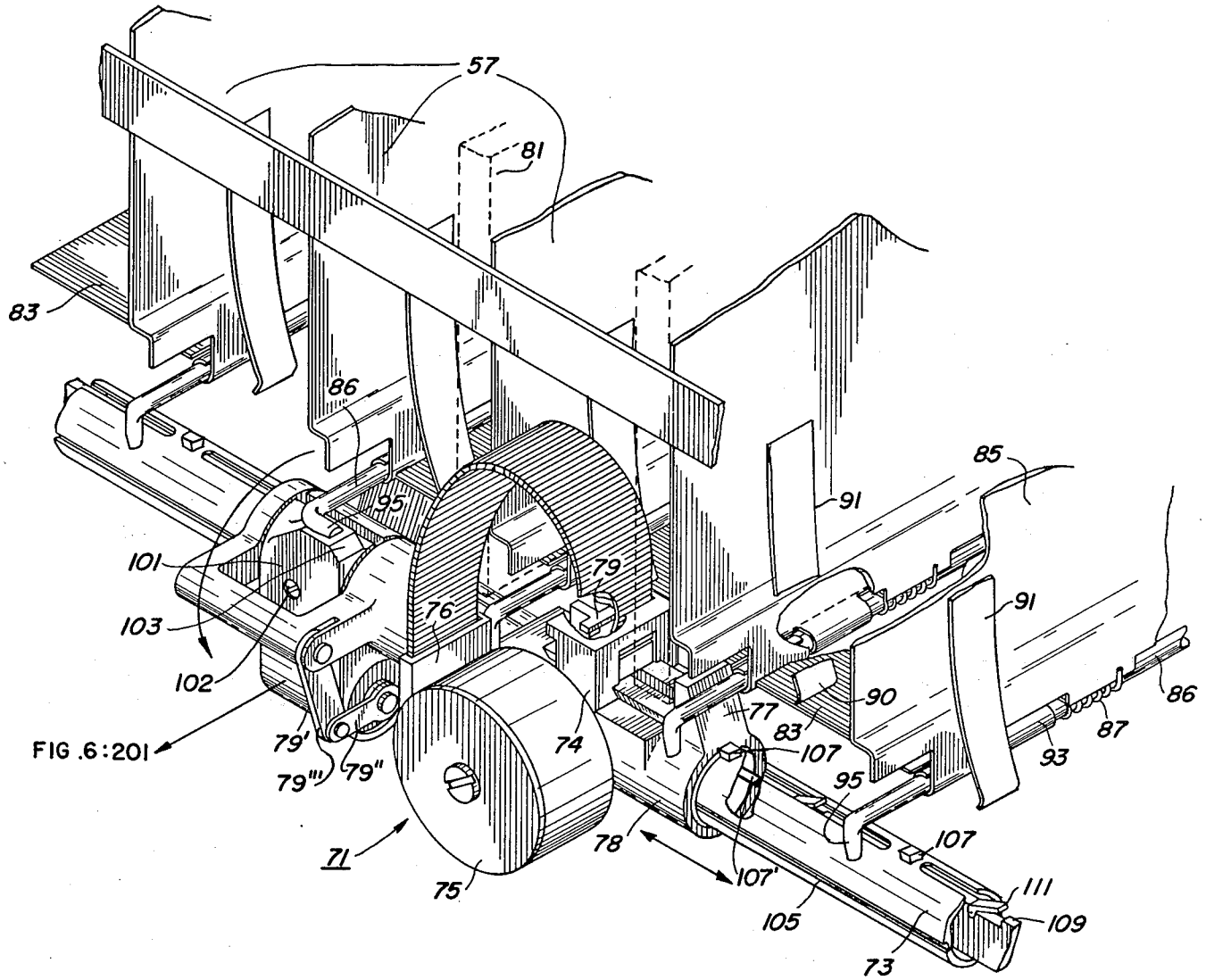
FIG. 5 is a perspective sectioned view of the automatic stapling apparatus.

According to another aspect of the present invention, the collating apparatus is further provided with automatic means for stapling the collated and edge aligned sheets in the respective bottom of collecting bins. The apparatus is also provided with means automatically removing the stapled sheets from the bottom bins. As illustrated in FIG. 5, a suitable automatic stapling apparatus 71 may be movably mounted on a stationary guide rail 73 along the bottom front of the collecting bins. As shown, the apparatus may include a staple driving head 74, staple supply 75, means 76 for feeding the staples into the staple driving head 74, a driver 79 and an anvil 77. These elements are integrally connected to a cylindrical carriage member 78. The cylindrical member 78 is mounted to ride on the guide rail 73. When actuated by the operation of a suitable solenoid (not shown), the hammer 79 hits a trigger (not shown) in the staple head 74 and staples the sheets which are already jogged and edge aligned with the last or end one of the staples.

As illustrated in FIG. 5, each of the bottom members 83 of the collecting bins 57 are releasably coupled to a right side bin wall 85 by a linkage rod and spring bias means 87. The spring is disposed on the bottom end of the wall 85, the one end being rigidly attached to the wall 85 and the other end to the bottom. The spring applies a clockwise torque to the bottom members 83. Guides 91 are provided to guide leading or bottom ends of the sheets coming into the collecting bins. The ends 90 of guides 91 are utilized to act as stops to locate bin bottoms 81 and stops the bottom at a position slightly inclined to the right, as shown in FIG. 4 and 5. The respective rod member 86 spring coupled to each of the walls 85 is in turn rotatably held in position as illustrated in FIG. 5 at hinges 93 at the bottom of the wall 85. The front end of the rod members is bent at an angle as shown. The bent portion 95 is used as a tripper arm. The arm 95 is held in downward position by the spring 87 and maintained in that position. The rod 86 is free to rotate about the hinge 93 so that when the arm 95 is rotated counterclockwise, the bottom member 86 is rotated counter-clockwise to open the bottom of the bin. The opening action is provided by the stapling apparatus as will be explained below in detail.

Means for rotating the arm 95 generally include a block member 101 having a cam surface 103 thereon. Block member 101 is freely slidable on rail 73 but is keyed to stop 105 therein by screw 102 to prevent rotation of block 101 relative to the rail. The stapling apparatus is mounted so that in operation, it is rotated into a stapling position as shown in FIG. 5 by rotary solenoid 79' which is mounted on block member 101 through arm 79'' and link 79'''. After the stapling operation, the apparatus is rotated counter-clockwise to move the stapling head and other members out so that, as the apparatus moves to the next bin, it clears the bin wall 85 and stapled sheets 81. After the counter-clockwise rotation, the apparatus is moved to the right to the next bin.

To move the stapling head and carriage, a suitable reciprocating rod member 109 is disposed within the rail 73. The rod member 109 includes spring biased protruding members 111 for engagement with the carriage as the member 111 moves to the right. A plurality of dogs 107 are provided along rail 73 to maintain carriage 78 in position for the stapling operation. In order to unlock carriage 78 from locking dogs 107 disposed on the rail 73, there is provided an open channel 107' along the length of the carriage member 98. The channel is so positioned that after the stapling apparatus is rotated counter-clockwise, the channel is in alignment with dogs 107 to clear the dogs, reciprocating movement of rod 109 causing protruding members 111 to engage the bottom surface of the channel to move the assembly to the right or left. As stated above, the dog 107 is integral with the guide rail 73 and is positioned to stop the anvil 76 at the right place in front of the corresponding bin when the stapling apparatus is moved clockwise into the position to staple. The the stapler assembly operates as follows.

Normally, when it is not in operation, the assembly is moved to the extreme left position. When actuated the apparatus is advanced to the right to the first bin. Then the assembly is rotated clockwise into the stapling by solenoid mechanism 79' . The stapler mechanism is then actuated under the command of a control signal to drive the hammer 79 against the anvil 77. The hammering action staples the sheets near the front bottom corner.

After stapling action, the assembly is rotated counterclockwise and then advanced to the next bin. As the assembly moves to the right, the cam surface 103 causes the end 95 of the arm 86 of the sheets just stapled to rotate counter-clockwise. This opens the bottom 83 of the bin and thereby releases the stapled sheets into the belt below.

As illustrated in FIGS. 2 and 3 there may be provided a suitable conveyor belt 112 and a suitable means including a motor MOT-2which may actuate the conveyor belt so that the conveyor belt transports the stapled copy sheets to the left. There is also provided a suitable open face collecting tray 97 for receiving the stapled sheets carried out by the conveyor belt. A suitable means may be provided to respond to the control signals from the control logic to actuate the conveyor belt motor some time to the stapling operating so that the conveyor is moving when the stapled set of sheets drops on it and de-actuate and stop the conveyor belt some time after the last stapling operation, when the last stapled sheets are carried out and removed from the conveyor belt.

Figure 8:
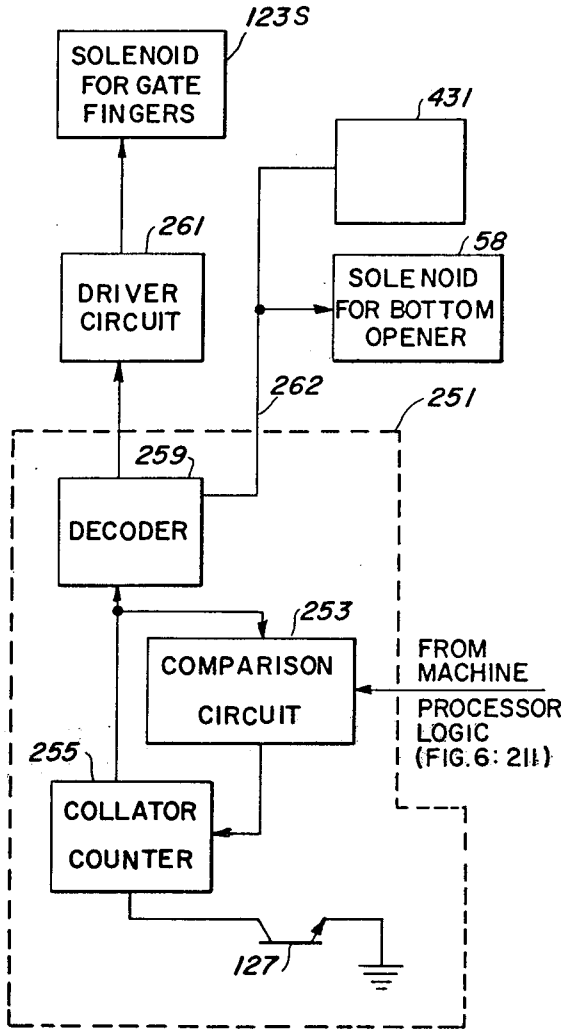
FIG. 8 is a block diagram of the control for the solenoids operative for deflecting sheets into collating bins, and releasing the collated sheets into collecting bins.
Figure 7:
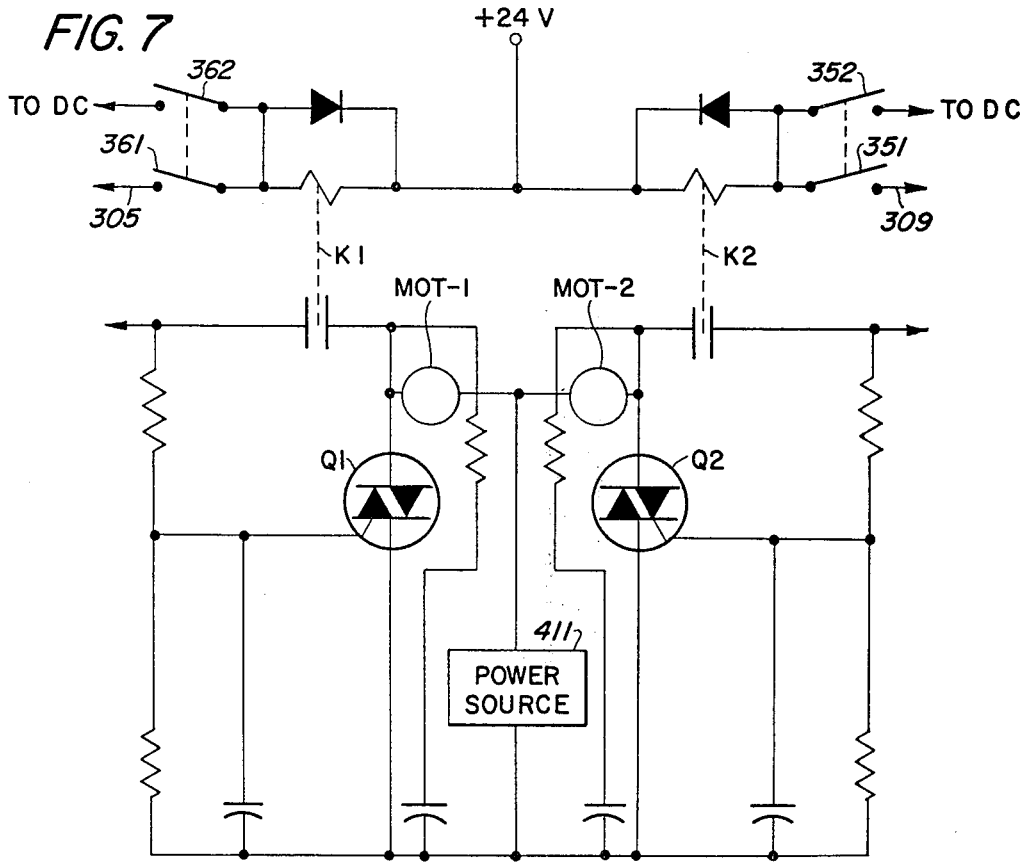
FIG. 7 is a circuit diagram of the motor circuit of the control circuitry.

According to another aspect of the present invention, there is provided a suitable means including a control logic illustrated in FIGS. 6–8 for operating the aforedescribed apparatus for automatically collating, collecting, jogging, stapling and removing copy sheets so that all the operator has to do is program the machine, e.g., punch the keys S1 (FIG. 1) to correspond to the number of copies to be made, press the key S2 to program the machine for operation in the collation mode, place the originals, and press the start button S3. The collating apparatus is then operated automatically to collate, jog the collated sheets, staple and remove them in successive cycles until the copy run is complete. Thus, if the operator programs more than the bin capacity (e.g., more than 25 sets of copies in the above example), then the machine makes 25 sets of copies first, i.e., collate them and drop them into the collecting bins in the first cycle. While the rest of the operation of jogging and stapling operation takes place for the first 25 sets of copies, the second cycle of 25, or less depending upon the programmed copy number, are collated at the collating bins.

As illustrative control logic for operating the apparatus of the present invention will now be described. Referring to FIGS. 6 through 9, there is provided a collating logic 201 of a conventional nature designed to respond to the detected photosignals coming from the phototransistors 127, 128 and 208. It may be recalled that the phototransistor 127 is positioned to sense the passing of the copy sheets from the horizontal track 115 into the collating bins 56. The phototransistor 128 is disposed to sense the light source 126 from the opposite end as illustrated in FIG. 2 that senses the presence or absence of the copy sheets in the collating bins. The phototransistor 208 is designed to sense the presence or absence or sheets in the collecting bins depending upon whether or not the light supplied by the light source 207 is cut off by the presence of the sheets in the collecting bins 57 as illustrated in FIG. 2. The collating logic 201 is designed to send out appropriate signals to the exposure counter 209 of the xerographic apparatus XP, the motor drive circuit 210, and other circuit elements as shall be explained in detail hereinafter.

The collating logic 201 responds to the photodetection signals and operates in conjunction with the processor control logic 211 of the xerographic apparatus to integrate the operational activities of the collating apparatus with the operation of the xerographic copier.

In operation, the collate logic 201 responds to the signals from the phototransistors 127, 128 and 208 and certain signals from the machine processor logic 211 and generates output signals to actuate the fingers 123 in sequence, actuate the solenoid 58 to release the bottoms of the collated bins, actuate the jogging motor MOT-1,the conveyor belt motor MOT-2and send trigger signals to the solenoid 79' in a certain manner, as described below.

Referring to FIGS. 6 and 8, in operating the gate fingers 123 and the collating bin bottom releasing solenoid 58, the collating logic is provided with a circuitry 251 for detecting the copy counts signified by the exposure counter 209 and stores it in a comparison circuit 253. As the machine starts producing copies and as the first copy reaches the first collating bins, the phototransistor 127 detects it and applies an output signal to a collator counter 255. The counter 255, in turn, applies a pulse to a decoder 259 and to the comparison circuit 253. As the machine starts producing the copies and as the first copy reaches the first collating bin, the transistor 127 detects it and applies an output signal to a collator counter 255. The counter 255, in turn, applies a pulse to a decoder 259 and to the comparison circuit 253. The decoder in turn applies a pulse to a driver circuit 261, which, in turn, is adapted to actuate the solenoid 123 for the next gate finger. The foregoing process continues until all the 25 bins are filled or until the copy run is completed if the copy run is less than 25. If the copy run is more than 25, then the machine logic controls the operation of copying and collating functions in successive cycles until the copy run is complete. The decoder is of such a design that it generates a trigger pulse to the solenoid 58 when the count reaches 25 or when the collator counter is reset signifying the completion of the copy run. The collator is reset when the counts counted by the phototransistor 127 reaches the counts stored in the circuit from the processor logic 211. When triggered, the solenoid 58 releases the collated copies by opening the bin bottoms as described heretofore.

In the aforementioned manner the collate logic operates to fill the collating bins 56 and release the collated sheets into the collecting bins 57 when all of the collating bins are filled or copy run is completed even through all the bins may not be filled. If the collecting bins are not available due to the presence of sheets in the bins from the previous operation, this is detected by the phototransistor 208 in the form of absence of light and this condition is sensed by the collate logic 201. In turn, the collate logic 201 causes the machine processor logic 211 to prevent the further operation of the machine. It also prevents the solenoid 58 from actuating and thereby releasing the newly collated sheets into the collecting bins 57. When the sheets are removed, the light is sensed by the sensor 208. This enables the operation to resume automatically.

The collate logic 201 is used to drive the motor MOT-1for vibrating or jogging the collating bins 57, and thereby the edges of the sheets, the stapler, and actuate the motor MOT-2to actuate the conveyor belt, and thereby remove the stapled sheets, in a timed manner as follows. The drive circuitry for the motors MOT-1and MOT-2 may be of any suitable design such as that illustrated in FIG. 8. It includes a pair of triacs QL and Q2, a pair of relays K1 and K2 and associated circuit elements connected as shown for triggering the associated circuit elements connected as shown for triggering the associated triacs Q1 and Q2 in a conventional manner and thereby energizing the motors MOT-1and MOT-2. More specifically, when the collate logic proves an enabling signal via the path 305, the drive circuit relay K1 is actuated and this, in turn, causes the triacs Q1 to operate and thereby energize the motor MOT-1. Once energized the motor is driven to vibrate the collecting bins 57. Similarly, when the collating logic 201 provides an output signal via its output lead 309, an enabling signal is provided to for the relay K2. Once actuated K2 in turn operates the triac Q2 thereby energizing the motor MOT-2 for the conveyor belt.

The operating signals for the stapling apparatus may be similarly provided by utilizing a motor drive circuit of the type shown in FIG. 7 described above or by using a suitable stepper motor 311 which is connected to respond to enabling signals from the collate logic 201 via a path 313. More particularly, the enabling signals from logic 201 is timed to occur after the completion of jogging operation. The signals are timed to move the stapling apparatus to the right in increments to the successive bins. In timed relationship with the enabling signals, sequential actuating signals are applied to the solenoid 79' via a path 315 for effecting the rotation of the carriage about rail 73.

Where it is desirable to effect the stapling operation manually, the operator may turn off the stapler actuating means by a by-pass switch (not shown) and manually staple the sheets.

In order to render the present collating apparatus more flexible, there is provided a manual bypass for the motors MOT-1 and MOT-2 in jogging the collecting bins and operating the conveyor belt. This may be readily implemented by providing bypass switches 351 and 352 and 361 and 362 as illustrated in FIG. 7. By manually opening the switches 351 and 352 the operator can remove the control of the motor drive circuit FIG. 5 from the output of the collating logic via the output path 305 and 309 and place it under manual operation. When the operator wishes to operate the conveyor belt and vibrate the collecting bins independently of the operation of the rest of the machinery, the switches 351 and 352, respectively may be closed to operate the motors MOT-2 to run the conveyor belt and the motor MOT-1 to jog the collecting bins.

Hereinabove the various features of the present invention have been described with respect to a specific illustrative embodiment in FIGS. 1–8, in conjunction with a collating apparatus comprising a set of bins for collecting operation, another set of bins for receiving the collated sheets, means for jogging, and means for stapling the jogged sets of collated sheets one at a time in succession. A number of suitable variations or changes may be made to the apparatus within the spirit and scope of the present invention taught above.

Figure 9:
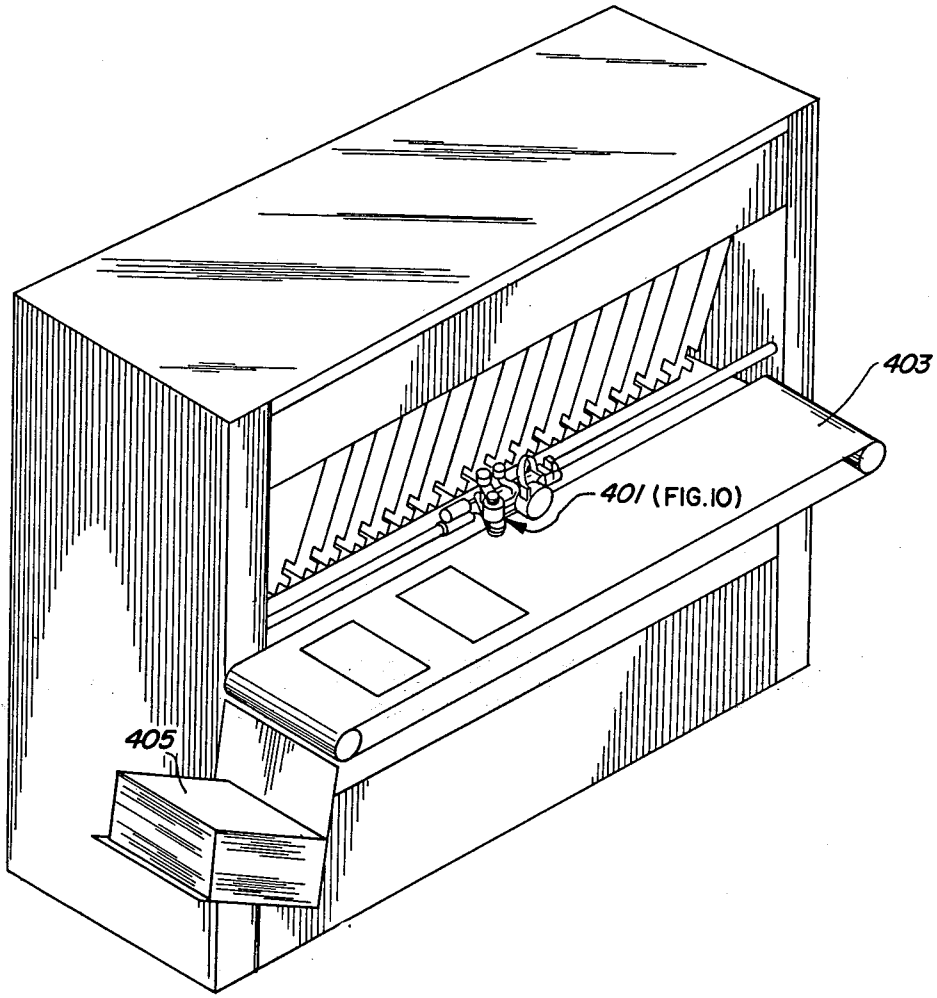
FIG. 9 is a perspective view of another embodiment of the collating apparatus.

For example, as illustrated in FIG. 9, for economy or other reasons, one may wish to use only one set of bins for collating the copy sheets, edge align and staple respective collated sheets. For edge alignment pusposes, a suitable vibrating means such as a motor and a pair of belts used in jogging the collecting bins 57 illustrated in FIGS. 2 and 3 may be used. To aid the alignment process, the bins may be also inclined slightly to the right and backwardly, whereby the back and the right side wall and bottom provides the necessary guide edges. Also for example, the drive belt advancing mechanism illustrated and described in connection with FIG. 5 in advancing and indexing the stapling apparatus carriage may be replaced by a lead screw type of mechanism.

Figure 10:
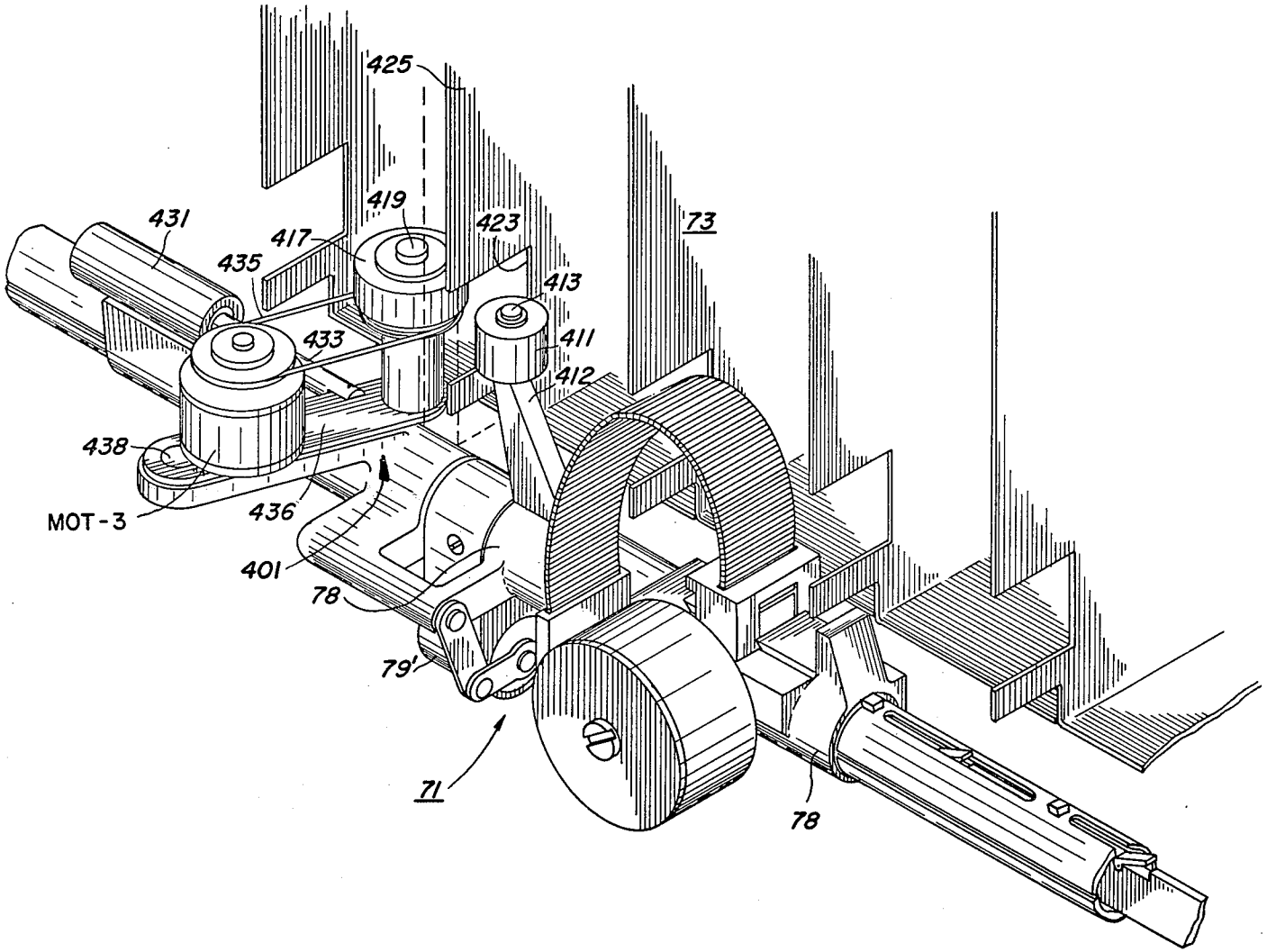
FIG. 10 is a perspective view of a means for ejecting stapled sheets.

Upon completion of the collating and edge aligning operation, the stapling operation may be performed by using an automatic stapling apparatus such as that illustrated in FIG. 10 which is similar design to that shown in FIG. 5. The stapled set of sheets may then be dropped to the bottom under the command of the control logic and removed from the bins by having the bottom of the bins openable as described above in conjunction with FIG. 4.

In some applications, it may be necessary or preferable that the sets of stapled sheets be ejected to the front by suitable means 401. The ejected stapled sheets may then be placed on a conveyor belt 403 as illustrated in FIG. 9. The belt 403 would then transport stapled set of sheets to a suitable stacker 405, as illustrated. For ejecting the stapled sheets sidewise an ejecting apparatus of the type shown in FIG. 10 may be used advantageously in conjunction with a stapler similar to stapler 71 shown in FIG. 5. The ejecting apparatus may comprise a pair of wheels comprising; a driven wheel 411 mounted and positioned to rotate freely about a vertical axis 413 at the end of a column 412 mounted on the carriage frame 78, and a drive wheel 417 mounted on an axis 419. The driven wheel 411 is positioned fixedly on the carriage 78 and so positioned that its peripheral surface will touch or be in contact against one side a set of sheets 421, when the stapling apparatus is moved into the stapling position. There is a suitable recess 423 in the side wall 73 into which the wheel 411 can be brought, as the carriage rotates clockwise to bring the stapler 71 into stapling position so that the peripheral surface of wheel 411 can be brought into contact with the sheets 421.

There is provided a solenoid 431 mounted on the carriage 78 and a retractable solenoid arm 433 connected as shown. A motor MOT-3, when energized, drives the drive wheel 417 by a belt 435. The motor MOT-3 is mounted at one end of a pivotal plate member 436 as shown. The drive wheel is mounted at the other end as illustrated. The retractable arm 433 is normally withdrawn when the solenoid is not energized. Upon energization the solenoid arm 433 rotates the plate 436 clockwise about a pivot 438 and this pushes drive wheel 417 to the right clockwise about the motor pivot 438.

As the drive wheel 417 is pressed to the right it comes in contact with the stapled sheets 421 and against the freely rotating wheel 411. By driving or rotating the drive wheel 417 clockwise the stapled set of sheets 421 is ejected forward as the wheel 417 is pressed and rotated against the collated sets of sheets 421, and freely rotating wheel 411 rotating counter-clockwise also assists the ejection operation.

The enabling or actuating signals for the motor MOT-3 and the solenoid 431 are applied respectively in timed relationship by the control logic 201 in a suitable manner. Preferably, the logic enables the stapling the ejecting operation to take place concurrently. Thus, as the set in the right bin is stapled, the set in succeeding or the left bin is ejected. There is provided, preferably, means (not shown) for detecting the ejection and for allowing the apparatus to move and index to the next bin only when the ejection operation is complete. The motor MOT-3 could be left running all the time without any difficulties. The solenoid 431 may be actuated by the decoder 259 of the control logic. Thus, in operation, the control logic provides necessary command signals to the solenoid 431 so that the ejecting operation is implemented for each set of the stapled sheets the carried forward by the carriage 78 and indexed into the successive operation positions and staple one bin while ejecting a stapled set of sheets in a preceeding bin until all of the bins are stapled and ejected.

While the invention described with respect to illustrative embodiments hereinabove, it is not confined to the details set forth hereinabove and this application is intended to cover such modificiations or changes that may come within the scope of the following claims:

What is claimed is:

1. An apparatus for grouping discrete items to form a plurality of completed sets according to a predetermined program comprising:

a first horizontal array of bins, a second horizontal array of bins disposed under said first set of bins in alignment therewith, means for inserting the items into said first array of bins according to the predetermined program, actuable means movable between a retaining position and a releasing position, said means, when in the retaining position, being adapted for retaining the items in said first array of bins while they are being inserted therein, control means including means for detecting the completion of the sets and generating a completion signal, said actuable means being actuated to said releasing position in response to said completion signal for releasing said sets into said second array of bins, said control means further including first sensing means for generating a first presence or a first absence signal to indicate the presence or absence of items in any of said first array of bins, second sensing means for generating a second presence or a second absence signal to indicate the presence of the absence of items in said second array of bins, means responsive to said first presence signal for generating a first inhibit signal, and means responsive to said first inhibit signal for preventing insertion of said items into said first array of bins.

2. The apparatus according to claim 1, wherein said control means further includes means responsive to said second presence signal for generating a second inhibit signal and means responsive to said second inhibit signal for preventing said actuable means from releasing the sets from said first array of bins into said second array of bins, means responsive to said second absence signal for enabling said actuable means for releasing said sets from said first array of bins into said second array of bins when completion of the sets in said first array of bins is detected by said control means.

3. An apparatus for grouping discrete items to form a plurality of completed sets according to a predetermined program comprising:

a first horizontal array of bins, a second horizontal array of bins disposed under said first set of bins in alignment therewith, means for inserting the items into said first array of bins according to the predetermined program, actuable means movable between a retaining position and a releasing position, said means, when in the retaining position, being adapted for retaining the items in said first array of bins while they are being inserted therein, control means including logic circuitry for monitoring the completion of the sets and generating a completion signal, said actuable means being actuated to said releasing position in response to said completion signal for releasing said sets into said second array of bins to empty said first array of bins, and, means for preventing said actuable means from releasing the sets in said first array of bins when said second array of bins are not empty.

4. An apparatus for grouping discrete items to form a plurality of completed sets according to a predetermined program comprising:

a first horizontal array of bins, a second horizontal array of bins disposed under said first set of bins in alignment therewith, means for inserting the items into said first array of bins according to the predetermined program, actuable means movable between a retaining position and a releasing position, said means, when in the retaining position, being adapted for retaining the items in said first array of bins while they are being inserted therein, control means including logic circuitry for monitoring the completion of the sets and generating a completion signal, said actuable means being actuated to said releasing position in response to said completion signal for releasing said sets into said second array of bins to empty said first array of bins, said items being sheets and said apparatus including means for vibrating said second array of bins to jog the sheets in each of said bins and edge align them.

5. The apparatus according to claim 4 further including:

means for stapling the sheets in said second array of bins.

6. A sheet handling apparatus comprising:

a first horizontal array of bins, a second horizontal array of bins disposed beneath said first set of bins in alignment therewith, deflector means for directing sheets into said first array of bins, actuable means movable between a retaining position and a releasing position, said means, when in the retaining position being adapted for retaining the sheets in said first array of bins, control means adapted for actuating deflector means for directing sheets into said first array of bins to provide collated sets of sheets therein, said control means further being adapted to actuate said actuable means for moving said actuable means to said releasing position for releasing the completed collated sets into said second array of bins, means for edge-aligning the sheets in said second array of bins, said edge-aligning means including means for simultaneously jogging the sheets.

* * * * *